US010186824B2

(12) United States Patent
Satou et al.

(10) Patent No.: US 10,186,824 B2
(45) Date of Patent: Jan. 22, 2019

(54) PRODUCTION METHOD FOR CONDUCTIVE MEMBER, CONDUCTIVE MEMBER, AND MOLD

(71) Applicant: SUMITOMO WIRING SYSTEMS, LTD., Mie (JP)

(72) Inventors: Osamu Satou, Mie (JP); Jiguo Zheng, Mie (JP); Masamichi Yamagiwa, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 15/771,912

(22) PCT Filed: Nov. 4, 2016

(86) PCT No.: PCT/JP2016/082753
§ 371 (c)(1),
(2) Date: Apr. 27, 2018

(87) PCT Pub. No.: WO2017/082157
PCT Pub. Date: May 18, 2017

(65) Prior Publication Data

US 2018/0309257 A1 Oct. 25, 2018

(30) Foreign Application Priority Data

Nov. 12, 2015 (JP) ..... 2015-221803

(51) Int. Cl.
*H01R 43/28* (2006.01)
*H01R 43/02* (2006.01)
(Continued)

(52) U.S. Cl.
CPC ..... *H01R 43/28* (2013.01); *H01B 5/12* (2013.01); *H01R 4/187* (2013.01); *H01R 4/60* (2013.01);
(Continued)

(58) Field of Classification Search
CPC ..... H01R 43/28; H01R 4/60; H01R 4/187; H01R 43/02; H01R 11/12; H01R 4/183; H01B 5/12
(Continued)

(56) References Cited

U.S. PATENT DOCUMENTS 4,922,072 A * 5/1990 Topel ..... B23K 11/002 219/56.1
6,027,589 A * 2/2000 Kato ..... H01R 13/5205 156/308.2
(Continued)

FOREIGN PATENT DOCUMENTS

JP 2005-319497 11/2005
JP 2015-060632 3/2015
(Continued)

OTHER PUBLICATIONS

Official Communication issued in International Bureau of WIPO Patent Application No. PCT/JP2016/082753, dated Jan. 17, 2017.

*Primary Examiner* — Sherman Ng
(74) *Attorney, Agent, or Firm* — Greenblum & Bernstein, P.L.C.

(57) ABSTRACT

A conductive member production method is performed with use of a die that includes a first die and a second die. The first die includes a protruding portion having a recession-shaped depression formed in a leading end surface, the depression including a molding surface that is inclined so as to gradually extend toward the leading end surface side while extending laterally from the depression. The second die includes a recessed portion into which the protruding portion can be inserted. The method includes a heating step of heating a weld portion formation region that is a portion, with respect to an extending direction, of a conductive member constituted by multiple metal strands, and a pressing step in which the heated weld portion formation region
(Continued)

is sandwiched between and pressed by the protruding portion of the first die and the recessed portion of the second die.

10 Claims, 6 Drawing Sheets

(51) Int. Cl.
*H01R 4/18* (2006.01)
*H01B 5/12* (2006.01)
*H01R 4/60* (2006.01)
*H01R 11/12* (2006.01)

(52) U.S. Cl.
CPC ..... *H01R 43/02* (2013.01); *H01R 4/183* (2013.01); *H01R 11/12* (2013.01)

(58) Field of Classification Search
USPC ..... 174/128.1
See application file for complete search history.

(56) References Cited

U.S. PATENT DOCUMENTS

| | | | |
|---|---|---|---|
| 9,444,154 | B2 | 9/2016 | Suso |
| 2015/0075863 | A1 | 3/2015 | Suso |

FOREIGN PATENT DOCUMENTS

| | | |
|---|---|---|
| WO | 2014/077143 | 5/2014 |
| WO | 2014/077144 | 5/2014 |

* cited by examiner

PRODUCTION METHOD FOR CONDUCTIVE MEMBER, CONDUCTIVE MEMBER, AND MOLD

TECHNICAL FIELD

The present invention relates to a conductive member that includes multiple metal strands, a production method for the same, and a die used in the production method for producing the conductive member.

BACKGROUND ART

In a wire harness for installation in a vehicle such as an automobile, a terminal-equipped electrical wire includes a terminal that is crimped to the end portion of an electrical wire.

For example, in an example shown in Patent Document 1, a terminal-equipped electrical wire is produced using a braided wire as the electrical wire. In Patent Document 1, a crimp-receiving portion is formed by welding the end portion of the braided wire, and the terminal is crimped to this crimp-receiving portion.

CITATION LIST

Patent Documents

Patent Document 1: JP 2015-060632A

SUMMARY OF INVENTION

Technical Problem

In Patent Document 1, the crimp-receiving portion is formed by using resistance welding to weld together the metal strands that constitute the braided wire.

Here, there are cases where there is a desire to produce the crimp-receiving portion by hot-pressing with use of a die. In this case, it is conceivable that wire strands are arranged between a protruding portion of a first die and a recessed portion of a second die, which have been heated, and then the first die and the second die are moved toward each other, thus hot-pressing the metal strands.

However, when metal strands are hot-pressed using a die, there are cases where a portion of the metal strands enters the clearances between the periphery of the protruding portion of the first die and the inner side surfaces of the recessed portion of the second die. The metal strands melt in the clearance and then harden to form a clearance-shaped portion, and if this clearance-shaped portion is formed in the crimp-receiving portion, a problem tends to occur in which the clearance-shaped portion hugs the protruding portion of the first die, and it is difficult to remove the crimp-receiving portion from the first die.

An object of the present invention is to provide a technique in which, when performing hot-pressing on metal strands, the portion formed by the melting and then hardening of metal strands can be easily removed from the protruding portion of the first die.

Solution to Problem

A conductive member production method according to a first aspect is performed with use of a die that includes a first die and a second die, the first die including a protruding portion having a recession-shaped depression formed in a leading end surface, the depression including a molding surface that is inclined so as to gradually extend toward a leading end surface side while extending laterally from the depression, and the second die including a recessed portion into which the protruding portion can be inserted, the method including: a heating step of heating a weld portion formation region that is a portion, with respect to an extending direction, of a conductive member constituted by a plurality of metal strands that are woven into a tube shape or a plurality of metal strands that are woven into a sheet shape; and a pressing step in which the heated weld portion formation region is sandwiched between and pressed by the protruding portion of the first die and the recessed portion of the second die.

A conductive member production method according to a second aspect is an aspect of the conductive member production method according to the first aspect. In the conductive member production method according to the second aspect, the conductive member is constituted by a plurality of sheathed metal strands that include the plurality of metal strands and electrically conductive sheath portions that respectively surround the plurality of metal strands, and in the heating step, heating is performed at a temperate that is higher than a melting point of the sheath portions and lower than a melting point of the metal strands.

A conductive member production method according to a third aspect is an aspect of the conductive member production method according to the first second or the second aspect. In the conductive member production method according to the third aspect, the depression of the first die includes a pair of the molding surfaces that are inclined so as to gradually extend toward the leading end surface side while extending in respective lateral directions from the depression.

A conductive member according to a fourth aspect is a conductive member constituted by a plurality of metal strands, the conductive member including: a weld portion in which at least a portion of the plurality of metal strands in an extending direction of the plurality of metal strands is welded, wherein a protrusion-shaped projecting portion is formed on the weld portion, the projecting portion includes an inclined surface that is inclined so as to gradually extend downward toward a central side of the weld portion while extending laterally from the projecting portion in a view from the extending direction. Also, a pair of lateral projecting portions formed on respective sides of the projecting portion are formed on the weld portion, and leading end portions of the pair of lateral projecting portions have a rounded shape.

A conductive member according to a fifth aspect is an aspect of the conductive member according to the fourth aspect. In the conductive member according to the fifth aspect, the conductive member is constituted by a plurality of sheathed metal strands that include the plurality of metal strands and electrically conductive sheath portions that respectively surround the plurality of metal strands, and the weld portion includes a portion in which the plurality of metal strands are bonded together by portions in which the sheath portions melted and hardened.

A conductive member according to a sixth aspect is an aspect of the conductive member according to the fourth aspect or the fifth aspect. In the conductive member according to the sixth aspect, the inclined surface includes a surface that is inclined in a straight line in a view from the extending direction.

A conductive member according to a seventh aspect is an aspect of the conductive member according to any one of the fourth to sixth aspects. In the conductive member according to the seventh aspect, the inclined surface includes a surface that is inclined in a curved manner in a view from the extending direction.

A conductive member according to a ninth aspect is an aspect of the conductive member according to any one of the fourth to seventh aspects. In the conductive member according to the ninth aspect, the projecting portion includes a pair of the inclined surfaces that are inclined so as to gradually extend downward toward the central side of the weld portion while extending in respective lateral directions from the projecting portion in a view from the extending direction.

A die according to a tenth aspect includes: a first die that includes a protruding portion having a recession-shaped depression formed in a leading end surface; and a second die that includes a recessed portion into which the protruding portion can be inserted, wherein the depression includes a molding surface that is inclined so as to gradually extend toward a leading end surface side while extending laterally from the depression. Also, spaces are provided between two side surfaces of the protruding portion of the first die and a pair of inner side surfaces of the recessed portion of the second die.

A die according to an eleventh aspect is an aspect of the die according to the tenth aspect. In the die according to the eleventh aspect, the depression includes a pair of the molding surfaces that are inclined so as to gradually extend toward the leading end surface while extending in respective lateral directions from the depression.

Advantageous Effects of Invention

In the first aspect, the performed steps include the heating step of heating the weld portion formation region, which is a portion, with respect to the extending direction, of the conductive member constituted by the metal strands, and the pressing step in which the heated weld portion formation region is sandwiched between and pressed by the protruding portion of the first die and the recessed portion of the second die. By performing the heating step and the pressing step on the weld portion formation region, the weld portion is formed in the conductive member. Also, the weld portion is provided with the projecting portion having a protrusion shape corresponding to the recession-shaped depression formed in the leading end surface of the protruding portion of the first die. Here, it is thought that when the conductive member is sandwiched between the protruding portion of the first die and the recessed portion of the second die, portions of the metal strands enter the clearances between the side surfaces of the protruding portion of the first die and the inner side surfaces of the recessed portion of the second die. It thought that when the portions that entered the clearances melt and then harden, the pair of lateral projecting portions are formed in the weld portion in addition to the projecting portion. Here, when compressed by the protruding portion of the first die, reaction force in response to compression force from the protruding portion of the first die is generated in the lateral projecting portions. When the first die is moved away from the second die, the aforementioned reaction force in the lateral projecting portions remains as residual stress inside the lateral projecting portions, and this residual stress includes a force acting in the direction of hugging the protruding portion of the first die, that is to say a force acting in a direction orthogonal to the direction of separation of the first die and the second die. For this reason, the pair of lateral projecting portions that hug the protruding portion of the first die can be a cause of difficulty in removing the weld portion from the first die. However, in the first aspect, the projecting portion of the weld portion includes an inclined surface that corresponds to the molding surface of the depression. The inclined surface is a surface that is inclined so as to gradually extend downward toward the central side of the weld portion while extending laterally from the projecting portion. In this case, the reaction force that is in response to the compression force from the protruding portion of the first die and that remains as residual stress in the inclined surface has a component in a direction orthogonal to the direction of separation of the first die and the second die, and a component in the direction of separation of the first die and the second die. For this reason, due to the inclined surface being formed in the projecting portion, force acting in a direction of separation of the weld portion from the first die is generated. Accordingly, the weld portion can be more easily removed from the protruding portion of the first die.

Also, in the second aspect, metal strands are bonded to each other by the portions in which the sheath portions melt and harden. At this time, the metal strands do not melt excessively, and maintain their original hardness to a certain extent. For this reason, in the process of formation of the weld portion, the case where the entirety of sheathed metal strands enters a fluid state is suppressed. In this case, workability in the pressing step improves, and the weld portion can be produced easily.

Also, in the third aspect, the recessed portion of the protruding portion of the first die includes the pair of molding surfaces that are inclined so as to gradually extend toward the leading end surface side while extending in respective lateral directions from the depression. In this case, the projecting portion includes a pair of inclined surfaces that correspond to the pair of molding surfaces, thus making it possible to increase the amount of force acting in the direction of separation of the weld portion from the first die.

Also, in the fourth aspect, the projecting portion includes the inclined surface that is inclined so as to gradually extend downward toward the central side of the weld portion while extending laterally from the projecting portion in a view from the extending direction of the metal strands. In this case, when the weld portion is formed by being pressed by the protruding portion of the first die and the recessed portion of the second die, the reaction force that is in response to compression force from the protruding portion of the first die and remains as residual stress in the inclined surface has a component in a direction orthogonal to the direction of separation of the first die and the second die, and a component in the direction of separation of the first die and the second die. For this reason, due to the inclined surface being formed in the projecting portion, force acting in a direction of separation of the weld portion from the first die is generated. Accordingly, the weld portion can be more easily removed from the protruding portion of the first die.

Also, in the fifth aspect, metal strands are bonded to each other by the portions in which the sheath portions melt and harden. At this time, the metal strands are likely to maintain their original shape instead of melting. For this reason, the weld portion is formed by the melting and then hardening of the sheath portions, while maintaining its shape to a certain extent due to the metal strands. In other words, the weld portion can be produced easily.

Also, in the sixth aspect, the inclined surface includes a surface that is inclined in a straight line in a view from the extending direction. In this case, force acting in a direction of separation of the weld portion from the protruding portion of the first die is generated.

Also, in the seventh aspect, the inclined surface includes a surface that is inclined in a curved manner in a view from the extending direction. In this case, force acting in a direction of separation of the weld portion from the protruding portion of the first die is generated.

Also, in the first aspect, the leading end portions of the pair of lateral projecting portions formed on respective sides of the projecting portion have a rounded shape. The pair of lateral projecting portions are portions formed by the melting and then hardening of portions of the metal strands that enter the clearances between the protruding portion of the first die and the recessed portion of the second die, for example.In this case, it is possible to suppress the case where the leading end portions of the pair of lateral projecting portions come into contact with and damage another member.

Also, in the ninth aspect, the projecting portion includes the pair of inclined surfaces that are inclined so as to gradually extend downward toward the central side of the weld portion while extending in respective lateral directions from the projecting portion in a view from the extending direction. In this case, it is possible to increase the amount of force acting in the direction of separation of the weld portion from the first die.

Also, in the tenth aspect, the recession-shaped depression formed in the leading end surface of the protruding portion of the first die includes the molding surface that is inclined so as to gradually extend toward the leading end surface side while extending laterally from the depression. In the case where the metal strands are pressed by this heated die for example, an inclined surface that corresponds to the molding surface of the depression is formed in the pressed portion of the metal strands. The inclined surface is a surface that is inclined so as to gradually extend downward toward the central side of the weld portion while extending laterally from the projecting portion. In this case, the reaction force that is in response to the compression force from the protruding portion of the first die and that remains as residual stress in the inclined surface has a component in a direction orthogonal to the direction of separation of the first die and the second die, and a component in the direction of separation of the first die and the second die. For this reason, force acting in a direction of separation of the weld portion from the protruding portion of the first the is generated, thus making it easier for the weld portion to be separated from the protruding portion of the first die.

Also, in the eleventh aspect, the depression includes the pair of the molding surfaces that are inclined so as to gradually extend toward the leading end surface while extending in respective lateral directions from the depression. In this case, the weld portion is provided with a pair of inclined surfaces that correspond to the pair of molding surfaces. For this reason, it is possible to increase the amount of force acting in the direction of separation of the weld portion from the first die.

DESCRIPTION OF EMBODIMENTS

Figure 1:
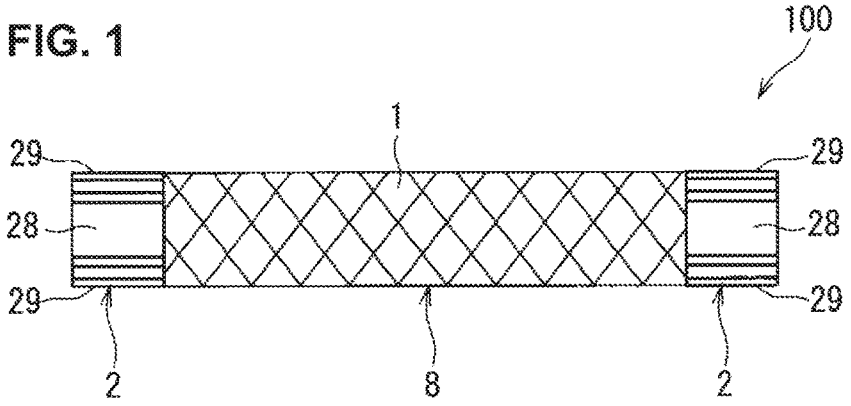
FIG. 1 is a plan view of a conductive member according to an embodiment.

Hereinafter, an embodiment will be described with reference to the accompanying drawings. The following embodiment is an example of an embodiment of the present invention, and is not intended to limit the technical scope of the present invention.

Embodiment

A conductive member 100, a conductive member production method, and a die 7 used in the conductive member production method according to an embodiment will be described below with reference to FIGS. 1 to 11. The conductive member 100 is constituted by multiple metal strands 11. Note that here, the conductive member 100 is constituted by sheathed metal strands 1 that include metal strands 11. The conductive member 100 also includes weld portions 2 in which the sheathed metal strands 1 have been welded. It is conceivable that the conductive member 100 is, for example, a portion of a wire harness for installation in a vehicle such as an automobile.

Figure 2:
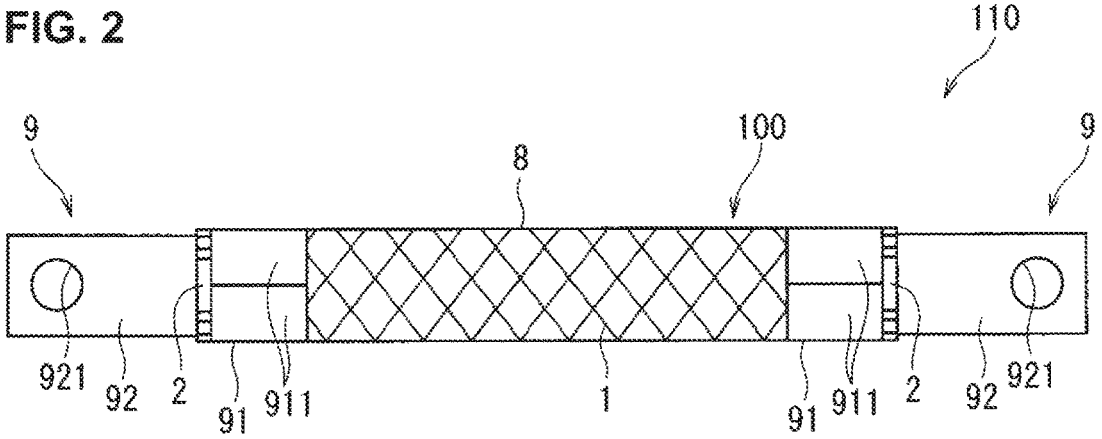
FIG. 2 is a plan view of a terminal-equipped conductive member that includes the conductive member according to the embodiment.
Figure 3:
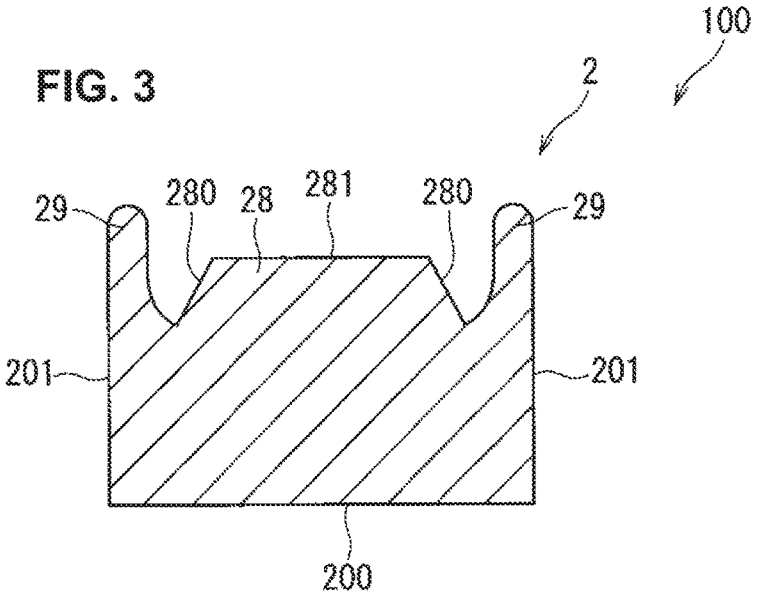
FIG. 3 is a cross-sectional view of a weld portion of the conductive member according to the embodiment.
Figure 4:
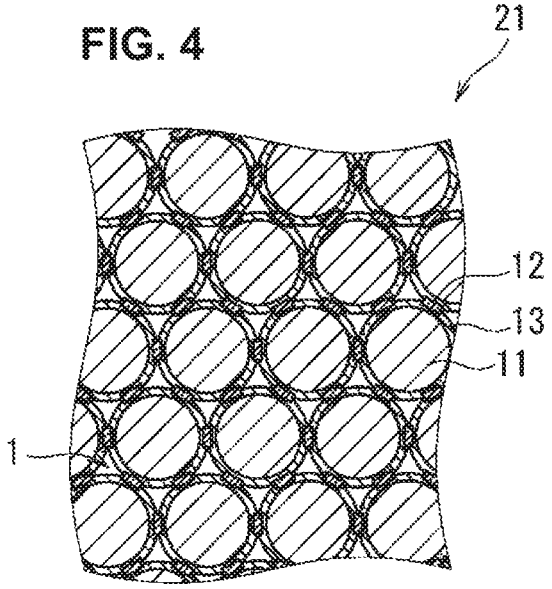
FIG. 4 is an enlarged cross-sectional view of the weld portion of the conductive member according to the embodiment.
Figure 5:
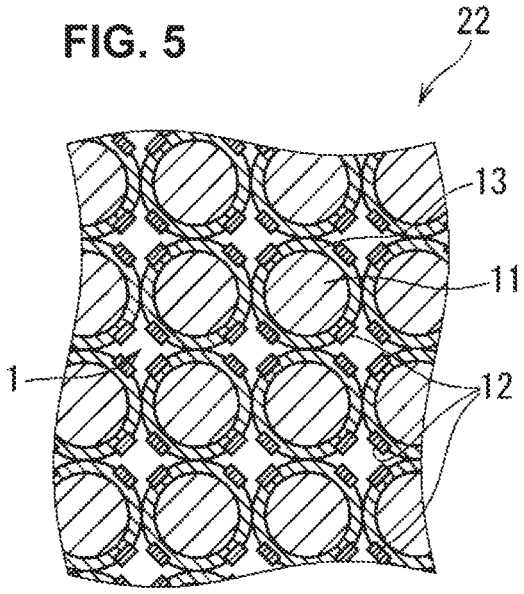
FIG. 5 is an enlarged cross-sectional view of the weld portion of the conductive member according to the embodiment.

First, the conductive member 100 will be described with reference to FIGS. 1 to 5. FIG. 1 is a plan view of the conductive member 100. FIG. 2 is a plan view of a terminal-equipped conductive member 110 that includes the conductive member 100 and terminals 9 that have been crimped to the weld portions 2 of the conductive member 100. FIG. 3 is a cross-sectional view of one weld portion 2 of the conductive member 100. FIGS. 4 and 5 are enlarged cross-sectional views of a portion of the weld portion 2 of the conductive member 100.

In the present embodiment, the conductive member 100 is constituted by multiple sheathed metal strands 1. The conductive member 100 is formed so as to be bendably flexible in the portion where the weld portions 2 are not formed.

As shown in FIGS. 4 and 5, each sheathed metal strand 1 includes a wire-shaped metal strand 11 and an electrically-conductive sheath portion 12 that surrounds the metal strand 11. The case where the sheath portion 12 is made of a metal is illustrated here.

In the present embodiment, an example is described in which the metal strand 11 is made of copper, and the sheath portion 12 is tin plating. In this case, when the metal strand 11 is plated with the sheath portion 12, an alloy portion 13 constituted by the metal strand 11 and the sheath portion 12 is formed on the outer circumferential surface of the metal strand 11. More specifically, the alloy portion 13 is formed so as to cover the majority of the outer circumferential surface of the metal strand 11, and the sheath portion 12 remains in portions of the outer circumferential surface of the sheathed metal strand 1. Accordingly, at the point in time when the metal strand 11 has been plated with the sheath portion 12, the sheathed metal strand 1 is constituted including the metal strand 11, the sheath portion 12, and the alloy portion 13. Note that a case is also conceivable in which the metal strand 11 is made of a metal other than copper, and the sheath portion 12 is a member other than tin plating. This will be described in detail later.

Also, in the present embodiment, the conductive member 100 is constituted by a braided wire in which multiple sheathed metal strands 1 are braided together. As another example, a case is also conceivable in which the conductive member 100 has a configuration in which multiple sheathed metal strands 1 are twisted together.

Here, as shown in FIGS. 1 and 2, the weld portion 2 is provided at each of two ends, with respect to the extending direction, of the braided wire constituted by the sheathed metal strands 1, thus obtaining the conductive member 100. Note that conceivable examples of the braided wire include a member obtained by weaving sheathed metal strands 1 into a tube shape, and a member obtained by weaving sheathed metal strands 1 into a sheet shape.

As shown in FIGS. 1 and 2, the conductive member 100 includes the weld portion 2, in which at least a portion of the sheathed metal strands 1 in the extending direction thereof is welded, and a bending portion 8 that is a portion in which the sheathed metal strands 1 are not welded. Here, the weld portion 2 is formed in each of two end portions of the conductive member 100. The bending portion 8 is formed in an intermediate region between the weld portions 2 at the two ends. Note that as another example, a case is also conceivable in which the weld portion 2 is formed in a portion of the intermediate region of the conductive member 100.

In the present embodiment, the bending portion 8 is a portion that is bendably flexible. The bending portion 8 is a portion in which the sheathed metal strands 1 are not bonded together. For this reason, in the bending portion 8, the sheathed metal strands 1 can move in directions crossing each other, and move in directions of separation from each other, for example. In this case, the conductive member 100 can flexibly deform in the bending portion 8.

On the other hand, the weld portion 2 is a portion in which at least a portion of the sheathed metal strands 1 are bonded together. Here, as will be described later, the weld portion 2 is formed by heating and pressing the sheathed metal strands 1 from the outer circumferential side with use of a die 7 that includes a first die 71 and a second die 72. For this reason, in the present embodiment, the weld portion 2 includes an outer layer portion 21 formed by the welding together of the sheathed metal strands 1 on the outer circumferential side. Note that the weld portion 2 is a portion that is to be crimped together with a terminal 9, and is a portion that is stiffer than the bending portion 8.

In the outer layer portion 21 of the weld portion 2, the metal strands 11 are bonded together by portions of the sheath portions 12 that have melted and then hardened. More specifically, here, the alloy portions 13 are formed when the sheath portions 12 are welded to (plated onto) the metal strands 11, the majority of the outer circumferential surfaces of the sheathed metal strands 1 are covered by the alloy portions 13, and the sheath portions 12 remain in portions of the outer circumferential surfaces. These remaining sheath portions 12 melt and then harden between adjacent sheathed metal strands 1, thus bonding adjacent sheathed metal strands 1 to each other. The metal strands 11 are thus bonded to each other by the sheath portions 12.

Also, in the present embodiment, by performing heating at a temperature lower than the melting point of the alloy portions 13, it is possible to suppress excessive melting of the metal strands 11 and the alloy portions 13 when forming the weld portion 2.

The following is a more detailed description of this. In the present embodiment, the metal strands 11 are made of copper, and the sheath portions 12 are tin plating. In this case, the melting point of the metal strands 11 (copper) is thought to be approximately 1085 degrees. Also, the melting point of the sheath portions 12 (tin) is approximately 230 degrees. Furthermore, the melting point of the alloy portions 13 constituted by the metal strands 11 and the sheath portions 12 is thought to be approximately 400 to 700 degrees (e.g., the melting point of Cu3Sn is approximately 415 degrees, and the melting point of Cu6Sn5 is approximately 676 degrees). Accordingly, it is thought that the weld portion 2 is formed by being heated at a temperature from 230 degrees to less than 700 degrees (e.g., a temperature of 300 degrees). In this case, the metal strands 11 are not likely to melt, and the metal strands 11 maintain their original shape (i.e., wire shape) to a certain extent in the outer layer portion 21 of the weld portion 2. Also, if heating is performed at a temperature lower than the melting point of the alloy portions 13, the alloy portions 13 are also not likely to melt. Accordingly, here, by melting mainly only the sheath portions 12, adjacent sheathed metal strands 1 become bonded together. It is therefore possible to suppress excessive stiffening of the weld portion 2. Also, in the process of formation of the weld portion 2, the case where the sheathed metal strands 1 melt entirely and enter a fluid state can be suppressed, thus making it possible to easily perform the press operation using the die and the operation of removing the conductive member 100 from the die after the molding of the weld portion 2.

Also, the sheath portions 12 melt a relatively large amount in the outermost portion of the outer layer portion 21, that is to say the portion that forms the outer circumferential surface of the weld portion 2. In this case, the relatively large portion of the sheath portion 12 in the fluid state hardens while being distributed at the outermost portion of the outer layer portion 21, thus suppressing the case where the metal strands 11 protrude from the outer circumferential surface of the weld portion 2. In this case, the case where the metal strands 11 protrude from a crimp portion 91 of the terminal 9 after the crimping of the weld portion 2 to the terminal 9 is suppressed.

Also, in the portion inward of the outer layer portion 21 of the weld portion 2 (hereinafter, an inner layer portion 22), it is thought that at least a portion of the sheathed metal strands 1 are in a state of being able to come apart due to the crimping of the terminal 9.

Specifically, in the present embodiment, the inner layer portion 22 is a portion that includes sheathed metal strands 1 that are not bonded to each other. It is thought that the inner layer portion 22 is more flexible than the outer layer portion 21 because the sheathed metal strands 1 included in the inner layer portion 22 can come apart.

Here, all of the sheathed metal strands 1 included in the inner layer portion 22 are in a state of being able to come apart. Specifically, as shown in FIG. 5, in the inner layer portion 22, the sheath portions 12 do not melt, and adjacent metal strands 11 are merely in contact with each other and not bonded together. In this case, in the inner layer portion 22, the sheathed metal strands 1 are more bendably flexible during crimping with the terminal 9, and it is possible to suppress excessive stiffening of the weld portion 2.

Note that it is thought that the inner layer portion 22 further includes a portion that includes sheathed metal strands 1 that are welded together and sheathed metal strands 1 that are not welded together. Specifically, it is thought that the inner layer portion 22 includes a portion that includes a mixture of a portion in which some of the sheathed metal strands 1 are welded to each other and a portion in which some are in a state of being able to come apart. In this case, it is thought that in the inner layer portion 22, there is a gradual change from the portion in which the sheathed metal strands are welded to the portion in which they are in a state of being able to come apart, this change occurring from the outer layer portion 21 side toward the center of the inner layer portion 22, that is to say toward the center of the weld portion 2.

As shown in FIG. 3, a protrusion-shaped projecting portion 28 is formed on each of the weld portions 2 of the conductive member 100. Note that here, a pair of lateral projecting portions 29 are also formed on each of the weld portions 2.

In the present embodiment, the weld portions 2 are each formed by being sandwiched between and pressed by the protruding portion 711 of the first die 71 and the recessed portion 721 of the second die 72. Here, a recession-shaped depression 710 is formed in a leading end surface of the protruding portion 711 of the first die 71. The projecting portion 28 is formed by this recession-shaped depression 710 formed in the leading end surface of the protruding portion 711 of the first die 71. The projecting portion 28 therefore has a protrusion shape that corresponds to the recession-shaped depression 710 of the first die 71.

Here, as shown in FIG. 3, the projecting portion 28 includes inclined surfaces 280 that are inclined so as to gradually extend downward toward the central side of the weld portion 2 while extending laterally from the projecting portion 28 in a view from the extending direction of the metal strands 11, that is to say the extending direction of the conductive member 100. Note that here, the projecting portion 28 includes a pair of inclined surfaces 280 that are inclined so as to gradually extend downward toward the central side of the weld portion 2 while extending in respective lateral directions from the projecting portion 28 in a view from the extending direction of the conductive member 100.

More specifically, here, the projecting portion 28 includes the pair of inclined surfaces 280 that are inclined in a straight line in a view from the extending direction of the conductive member 100 (hereinafter, planar-construction inclined surfaces), and a flat surface 281 that connects the pair of inclined surfaces 280. The flat surface 281 forms the leading end surface of the projecting portion 28, and has a flat shape. Also, here, the inclined surfaces 280 are continuous with the flat surface 281 while forming an angle. However, as another example, the inclined surfaces 280 may be connected to the flat surface 281 via a curved portion. Also, a configuration is also conceivable in which, instead of providing the flat surface 281, the pair of inclined surfaces 280 are connected via a curved surface.

The inclined surfaces 280 of the projecting portion 28 are a structure for facilitating removal of the weld portion 2 from the protruding portion 711 of the first die 71. Details of the actions of the projecting portion 28 and the inclined surfaces 280 will be described later.

Next, the pair of lateral projecting portions 29 will be described. The pair of lateral projecting portions 29 are formed on respective sides of the projecting portion 28. In other words, the projecting portion 28 is located between the pair of lateral projecting portions 29. Also, the leading end portions of the pair of lateral projecting portions 29 have a rounded shape.

In the present embodiment, the pair of lateral projecting portions 29 are portions formed by the melting and then hardening of portions of the sheathed metal strands 1 that enter the spaces (clearances 70) between the side surfaces of the protruding portion 711 of the first die 71 and the inner side surfaces of the recessed portion 721 of the second die 72.

Also, here, the leading end portions of the pair of lateral projecting portions 29 have a rounded shape. This pair of lateral projecting portions 29 is formed due to the clearances 70 being relatively wide. If the clearances 70 were excessively narrow, it is thought that the leading end portions of the pair of lateral projecting portions 29 would have a pointed shape. If such a pair of lateral projecting portions 29 are formed in the weld portion 2, a problem would likely occur in which another member comes into contact with and becomes damaged by the pair of later projecting portions 29, and the operation for crimping with the terminal 9 and the like are difficult to perform. However, if the leading end portions of the pair of lateral projecting portions 29 have a rounded shape as in the present embodiment, it is possible to suppress the occurrence of the aforementioned problems.

Also, as shown in FIG. 3, here, in a cross-section taken along a line orthogonal to the extending direction of the conductive member 100, a bottom surface 200 of the weld portion 2, which is on the side opposite to the upper surface on the projecting portion 28, and a pair of side surfaces 201, which extend upward from the bottom surface 200, are continuous while forming an angle of 90 degrees. However, a case is also conceivable in which the bottom surface 200 is continuous with the pair of side surfaces 201 via curved portions. Also, in the aforementioned cross-section, the bottom surface 200 and the pair of side surfaces 201 have a straight-line shape. Specifically, the bottom surface 200 and the pair of side surfaces 201 are flat surfaces. However, a case is also conceivable in which, in the aforementioned cross-section, the bottom surface 200 and the pair of side surfaces 201 have a curved-line shape, that is to say the bottom surface 200 and the pair of side surfaces 201 are curved surfaces.

Next, the terminal-equipped conductive member 110, which includes the conductive member 100 and the terminals 9 that have the crimp portions 91 crimped to the weld portions 2 of the conductive member 100, will be described with reference to FIG. 2.

In the present embodiment, the terminals 9 each include the crimp portion 91 and a connection portion 92. Also, the terminals 9 are members whose main component is a metal such as copper. The terminals 9 are electrically and mechanically connected to the conductive member 100 by the crimp portions 91.

Here, the crimp portion 91 includes a pair of crimp pieces 911 that can be crimped to the weld portion 2 of the conductive member 100. The pair of crimp pieces 911 are portions formed so as to be rise from the bottom portion terminal 9 toward respective sides of the weld portion 2.

In the terminal-equipped conductive member 110, the pair of crimp pieces 911 of the crimp portion 91 are crimped in a state of surrounding the weld portion 2 of the conductive member 100. Here, as described above, the outer circumferential surface of the weld portion 2 is covered by portion in which the sheath portions 12 have melted and then hardened, and therefore the metal strands 11 do not project outward. This thus suppresses the projection of the metal strands 11 of the conductive member 100 from between the pair of crimp pieces 911 after the weld portion 2 and the crimp portion 91 are crimped together.

Also, the connection portion 92 is a portion that can be connected to a partner member, which is the connection partner of the terminal 9. Here, the connection portion 92 is provided with a fastening hole 921 that can be bolt-fastened to a partner member such as a device of the vehicle.

Next, a conductive member production method according to the present embodiment will be described with reference to FIGS. 6 to 11. This conductive member production method is performed with use of the die 7 that includes the first die 71, which includes the protruding portion 711 having the recession-shaped depression 710 formed in the leading end surface, and the second die 72, which includes the recessed portion 721 into which the protruding portion 711 can be inserted.

The conductive member production method includes a heating step of heating a weld portion formation region 2X, which is a portion, with respect to the extending direction, of the conductive member 100 constituted by the metal strands 11 (here, the sheathed metal strands 1), and a pressing step in which the heated weld portion formation region 2X is sandwiched between and pressed by the protruding portion 711 of the first die 71 and the recessed portion 721 of the second die 72. Note that in the present embodiment, the conductive member production method includes a first step of setting the weld portion formation region 2X in the die 7, a second step of hot-pressing the weld portion formation region 2X with use of the die 7, and a third step of removing the conductive member 100 provided with the weld portion 2 from the die 7. Here, the second step is a step that includes the above-described heating step and pressing step.

Figure 6:
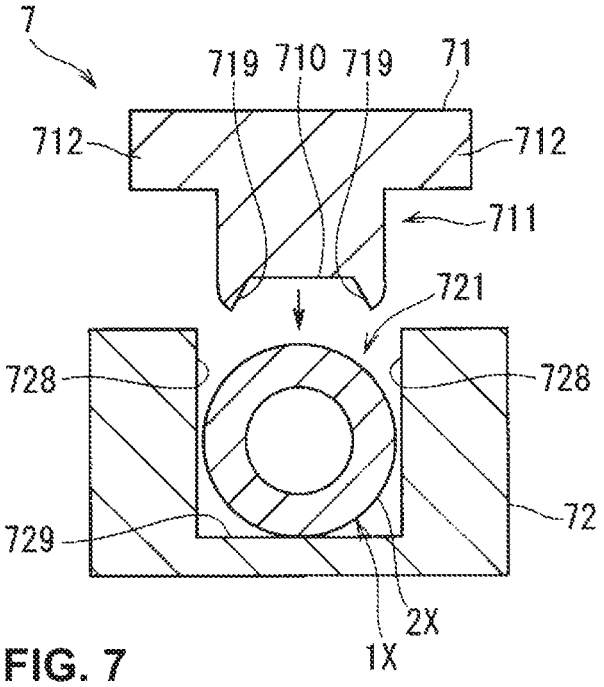
FIG. 6 is an illustrative diagram illustrating a conductive member production method according to the embodiment.
Figure 7:
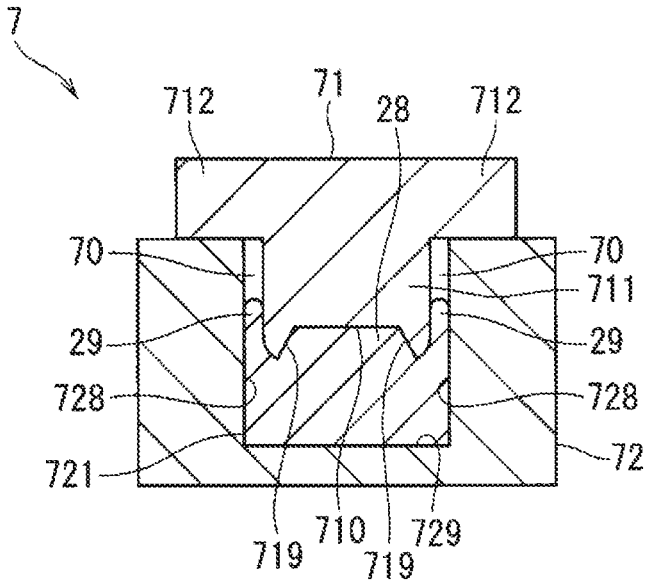
FIG. 7 is an illustrative diagram illustrating the conductive member production method according to the embodiment.
Figure 8:
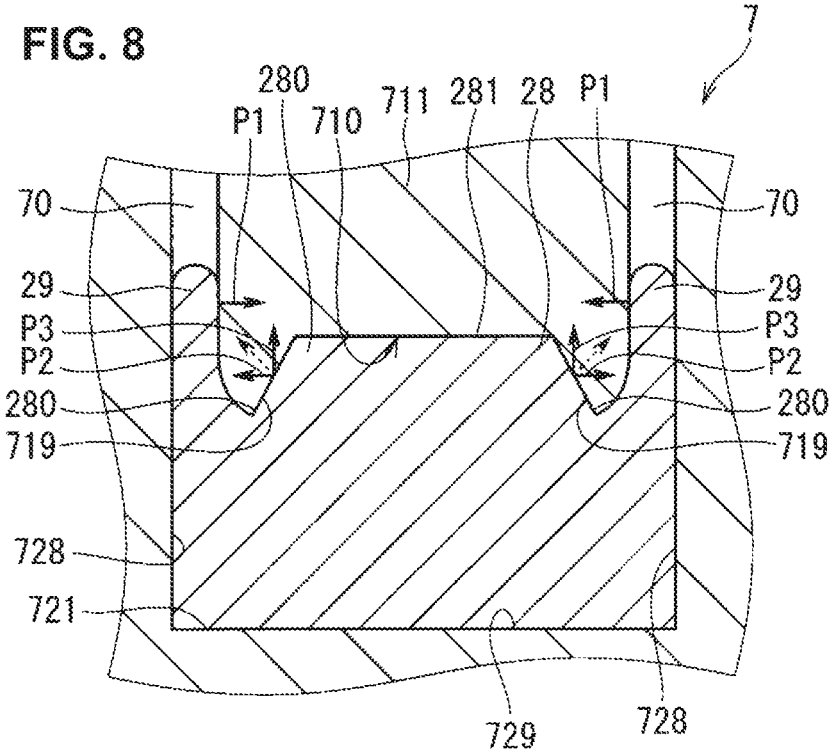
FIG. 8 is an illustrative diagram illustrating the conductive member production method according to the embodiment.
Figure 11:
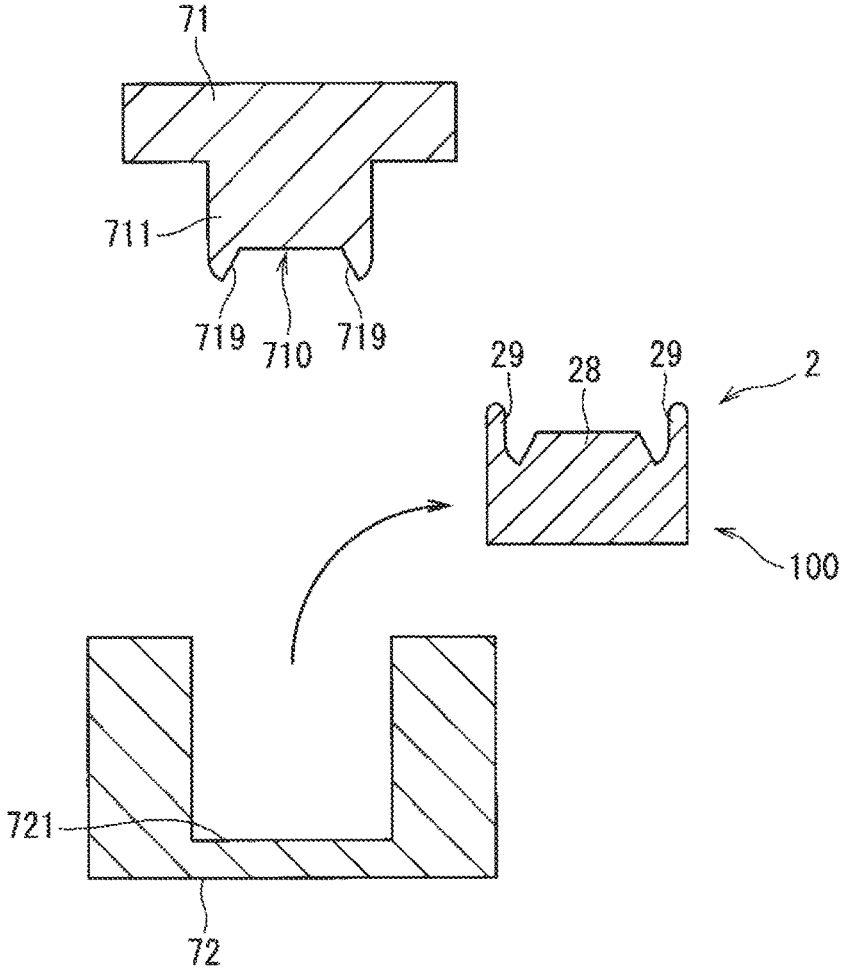
FIG. 11 is an illustrative diagram illustrating the conductive member production method according to the embodiment.

Note that FIGS. 6 to 8 and 11 are illustrative diagrams illustrating the conductive member production method of the present embodiment. FIG. 6 is an illustrative diagram illustrating the first step in the conductive member production method. FIGS. 7 and 8 are illustrative diagrams illustrating the second step in the conductive member production method. Note that FIG. 8 is an enlarged view of a region including the projecting portions 28 in FIG. 7. FIG. 11 is an illustrative diagram illustrating the third step in the conductive member production method.

Figure 9:
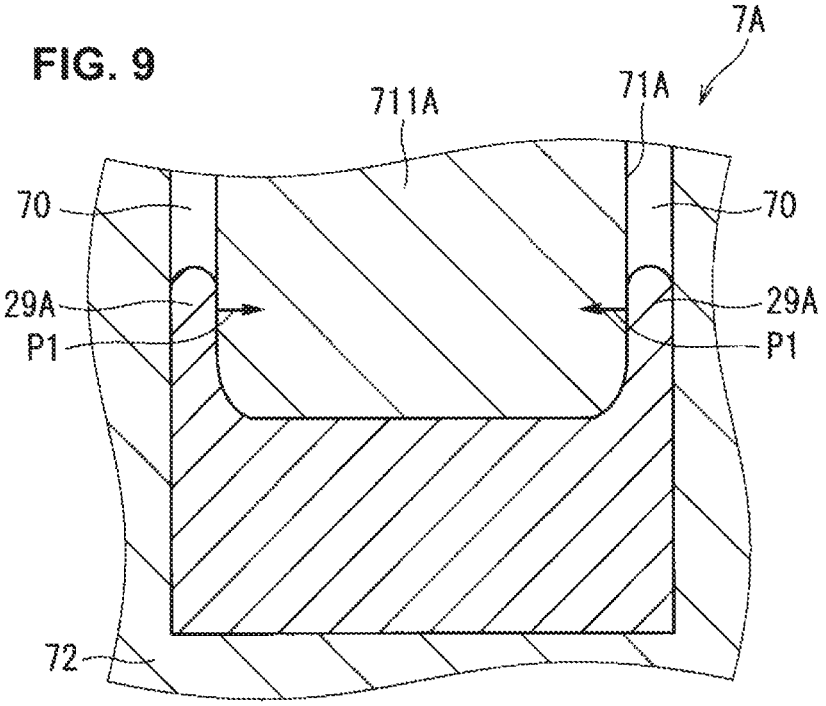
FIG. 9 is a reference diagram for illustrating the conductive member production method according to the embodiment.
Figure 10:
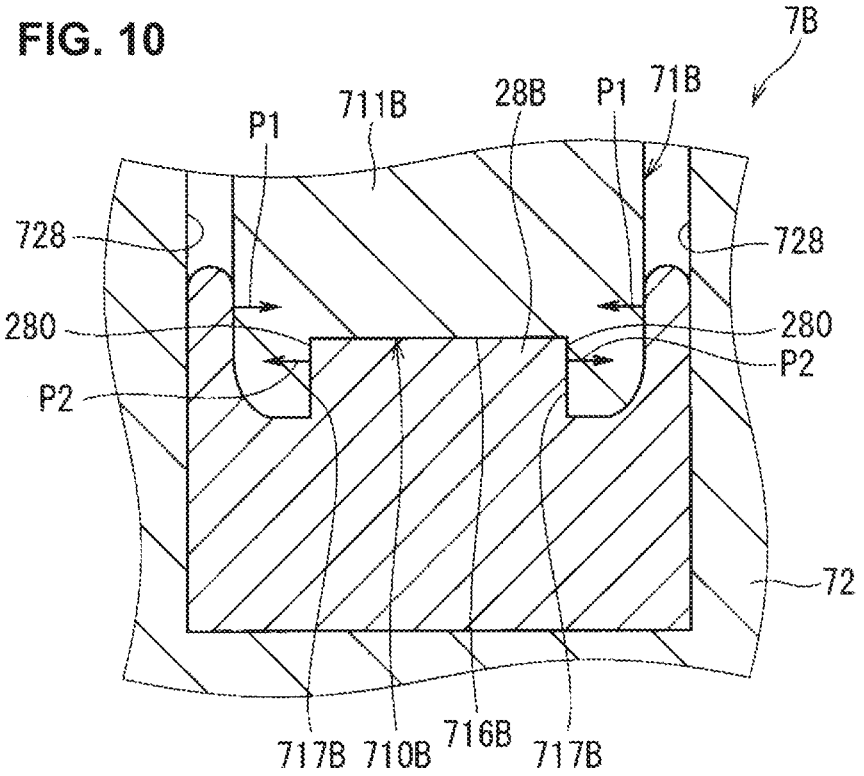
FIG. 10 is a reference diagram for illustrating the conductive member production method according to the embodiment.

Also, FIGS. 9 and 10 are reference diagrams for illustrating the conductive member production method of the present embodiment. FIGS. 9 and 10 are illustrative diagrams illustrating the second step performed with use of dies 7A and 7B that have a different structure from the die 7 used in the conductive member production method of the present embodiment. This will be described in detail later.

First, the die 7 will be described with reference to FIGS. 6 to 8 and 11. In the die 7, the first die 71 and the second die 72 are configured such that one/both can be moved toward or away from the other/each other. Also, here, the first die 71 and the second die 72 are configured to be capable of heating the weld portion formation region 2X. For example, a case is conceivable in which a heating mechanism such as a heater is built into the first die 71 and the second die 72. In this case, outer side surfaces of the protruding portion 711 of the first die 71 and inner side surfaces of the recessed portion 721 of the second die 72 are heated by the heating mechanism to a temperature for melting the sheath portions 12 of the sheathed metal strands 1.

The depression 710 formed in the leading end surface of the protruding portion 711 of the first die 71 includes molding surfaces 719 that are inclined so as to gradually extend toward the leading end surface side while extending laterally from the depression 710. Note that here, as shown in FIG. 6, the depression 710 includes a pair of molding surfaces 719 that are inclined so as to gradually extend toward the leading end surface side while extending in respective lateral directions from the depression 710. Note that the leading end surface of the protruding portion 711 is also the surface that first comes into contact with the weld portion formation region 2X when the first die 71 and the second die 72 are moved toward each other.

Also, the depression 710 is formed extending to the leading end surface of the protruding portion 711 in the vertical direction of the first die 71. Note that the vertical direction of the first die 71 is the direction that matches the extending direction of the conductive member 100 when the weld portion formation region 2X is being pressed by the first die 71 and the second die 72. In this case, the projecting portion 28 to be formed in the weld portion 2 is formed in the entirety of the weld portion 2 in the extending direction of the conductive member 100.

Also, here, the recessed portion 721 that enables arrangement of the sheathed metal strands 1 is formed in the second die 72. The recessed portion 721 includes a bottom surface 729 on which the weld portion formation region 2X is arranged, and a pair of side wall surfaces 728 that project from the bottom surface 729.

In the present embodiment, the recessed portion 721 of the second die 72 and the protruding portion 711 of the first die 71 are arranged opposing each other, the sheathed metal strands 1 are arranged inside the recessed portion 721, and the protruding portion 711 of the first die 71 is moved toward the recessed portion 721. The protruding portion 711 of the first die 71 is then inserted into the recessed portion 721 of the second die 72, and thus the sheathed metal strands 1 are sandwiched and pressed.

Also, in the present embodiment, the first die 71 further includes a contact portion 712. The contact portion 712 is a portion that comes into contact with the upper portions of the recessed portion 721 of the second die 72 when the protruding portion 711 is inserted into the recessed portion 721 by a predetermined amount. Here, as shown in FIG. 6, the contact portion 712 projects outward from the two sides of the protruding portion 711. The contact portion 712 suppresses excessive insertion of the protruding portion 711 of the first die 71 into the recessed portion 721 of the second die 72, and suppresses excessive pressing of the sheathed metal strands 1.

Also, in the present embodiment, while the protruding portion 711 of the first die 71 has been inserted into the recessed portion 721 of the second die 72, spaces (clearances 70) are formed between the two side surfaces of the protruding portion 711 and the pair of side wall surfaces 728 of the recessed portion 721.

The following describes details of the first step, the second step, and the third step of the conductive member production method of the present embodiment.

First, in the present embodiment, as shown in FIG. 6, in the first step, a braided wire 1X configured by the sheathed metal strands 1 is arranged inside the recessed portion 721 so as to come into contact with the bottom surface 729 of the recessed portion 721 of the second die 72. Here, an end portion of the braided wire 1X is arranged in the recessed portion 721 of the second die 72 in order to form the weld portion 2 at the end portion of the conductive member 100. Specifically, here, the end portion of the braided wire 1X in the extending direction is the weld portion formation region 2X.

After the first step, the second step is then performed. The second step includes the heating step and the pressing step. As shown in FIG. 7, in the present embodiment, in the second step, the heated first die 71 and second die 72 are moved toward each other, or one is moved toward the other one, thus pressing the weld portion formation region 2X at the end portion of the braided wire 1X. In other words, the heating step and the pressing step are performed at the same time. Note that the first die 71 and the second die 72 are heated at least before the start of the second step. For example, it is conceivable that the first die 71 and the second die 72 have already been heated before the start of the first step, or are heated at a time during the first step.

Also, in the heating step of the present embodiment, heating is performed at a temperature that is higher than the melting point of the sheath portions 12 and lower than the melting point of the metal strands 11. Note that here, heating is performed at a temperature that is higher than the melting point of the sheath portions 12 and lower than the melting point of the alloy portions 13 constituted by the metal strands 11 and the sheath portions 12. In this case, the metal strands 11 and the alloy portions 13 are not likely to melt, and it is possible to suppress the case where the entirety of the end portion of the braided wire 1X enters a fluid state. Workability in the pressing step performed with use of the die 7 thus improves. Also, the operation of, for example, removing the conductive member 100 from the die 7 after formation of the weld portion 2 can also be performed easily.

More specifically, in the heating step of the present embodiment, the surfaces of the die 7 that come into contact with the weld portion formation region 2X are heated to a temperature that is higher than the melting point of the sheath portions 12 and lower than the melting point of the alloy portions 13 constituted by the metal strands 11 and the sheath portions 12. Due to the weld portion formation region 2X at the end portion of the braided wire 1X being pressed by this die 7, the temperature on the outer peripheral side of the weld portion formation region 2X is higher than the melting point of the sheath portions 12, and the temperature on the central side of the weld portion formation region 2X is lower than the melting point of the sheath portions 12. Note that this state is realized by adjusting the heating temperature and heating time of the die 7, the pressing time for which the weld portion formation region 2X is pressed by the die 7, the pressure applied to the weld portion formation region 2X by the die 7, and the like in consideration of the number of sheathed metal strands 1 included in the weld portion formation region 2X for example.

In the present embodiment, the temperature on the outer peripheral side of the weld portion formation region 2X is higher than the melting point of the sheath portions 12, and it is possible to mainly melt the sheath portions 12 located at the outer circumferential surface of the sheathed metal strands 1. Note that here, heating is performed at a temperature that is higher than the melting point of the sheath portions 12 and lower than the melting point of the alloy portions 13, and therefore the alloy portions 13 in the weld portion formation region 2X are relatively unlikely to melt, and it is possible to suppress the case where the entirety of the weld portion formation region 2X enters a fluid state. More specifically, before heating is performed, the alloy portions 13 make up the majority of the outer circumferential surfaces of the sheathed metal strands 1, and the remaining sheath portions 12 make up the remaining portion of the outer circumferential surfaces of the sheathed metal strands 1. When heating is performed, mainly the sheath portions 12 melt, and by then performing pressing with the die 7 in this state, adjacent sheathed metal strands 1 come into contact with each other. While adjacent sheathed metal strands 1 are in contact with each other, the melted sheath portions 12 then harden, thus bonding together the adjacent sheathed metal strands 1 (i.e., the metal strands 11 for which the majority of the surface is covered by the alloy portions 13). This portion forms the outer layer portion 21 of the conductive member 100.

Also, heat from the die 7 is not likely to be transmitted to the portion of the weld portion formation region 2X on the central side. For this reason, the temperature in this portion is lower than the melting point of the sheath portions 12. As a result, on the central side of the weld portion formation region 2X, the sheath portions 12 do not melt, and the sheathed metal strands 1 are maintained in a non-bonded state. The inner layer portion 22 is thus formed.

Then, after the second step is complete, the first die 71 is moved away from the second die 72.

Here, in the present embodiment, when the weld portion formation region 2X is compressed by the protruding portion 711 of the first die 71, portions of the sheathed metal strands 1 are pushed into the clearances 70. The lateral projecting portions 29, which are formed by hot-pressing of the sheathed metal strands 1 pushed into the clearances 70, generate reaction force in response to the compression force from the protruding portion 711 of the first die 71. Also, as shown in FIG. 8, when the first die 71 is moved away from the second die 72, the aforementioned reaction force in the lateral projecting portions 29 remains as residual stress inside the lateral projecting portions 29, and becomes force acting in a direction of hugging the protruding portion 711 of the first die 71 (first force P1). Note that the first force P1 is also force acting in a direction orthogonal to the direction of separation of the first die 71 and the second die 72. For this reason, the pair of lateral projecting portions 29 that hug the protruding portion 711 of the first die 71 can be a cause of difficulty in removing the weld portion 2 from the first die 71.

However, in the present embodiment, the depression 710 is formed in the leading end surface of the protruding portion 711. For this reason, when the sheathed metal strands 1 are pressed by the protruding portion 711 of the first die 71, the sheathed metal strands 1 are also pushed toward the recession-shaped depression 710 in the leading end surface of the protruding portion 711 of the first die 71. For this reason, the amount of sheathed metal strands 1 that is pushed into the clearances 70 between the first die 71 and the second die 72 decreases, thus making it possible to reduce the first force P1 that hugs the protruding portion 711 of the first die 71 generated by reaction force from the lateral projecting portions 29.

For reference, the following describes a case where the recession-shaped depression 710 is not formed in the leading end surface of the protruding portion 711, as shown in the example shown in FIG. 9. In the example shown in FIG. 9, the depression 710 is not formed in the leading end surface of a protruding portion 711A of a first die 71A of a die 7A. In this case, because the depression 710 is not formed in the leading end surface of the protruding portion 711A, a large number of sheathed metal strands 1 are pushed into the clearances 70. Accordingly, there is an increase in the compression force from the protruding portion 711A of the first die 71A that acts on lateral projecting portions 29A, which correspond to the lateral projecting portions 29 of the present embodiment, and as a result, there is also an increase in the residual stress that remains inside the lateral projecting portions 29A. In other words, there is an increase in the first force P1 that hugs the protruding portion 711A of the first die 71A. As described above, unlike the present embodiment, in the example shown in FIG. 9 in which the recession-shaped depression 710 is not formed in the leading end surface of the protruding portion 711, the weld portion 2 is difficult to remove from the first die 71A.

Also, in the present embodiment, the recession-shaped depression 710 includes the pair of molding surfaces 719 that are inclined so as to gradually extend toward the leading end surface while extending in respective lateral direction from the depression 710. In this case, the projecting portion 28 that includes the pair of inclined surfaces 280 in correspondence with the pair of molding surfaces 719 of the depression 710 is formed in the weld portion 2 formed by being pressed by the protruding portion 711. Here, the inclined surfaces 280 are surfaces that are inclined so as to gradually extend downward toward the central side of the weld portion 2 while extending toward respective lateral sides from the projecting portion 28. In this case, the reaction force that is in response to the compression force from the protruding portion 711 of the first die 71 and that remains as residual stress in the inclined surfaces 280 has a component (second force P2) in a direction orthogonal to the direction of separation of the first die 71 and the second die 72, and a component (third force P3) in the direction of separation of the first die and the second die. In other words, due to the inclined surfaces 280 being formed in the projecting portion 28, the third force P3 acting in a direction of separation of the weld portion 2 from the first die 71 is generated. Accordingly, the weld portion 2 is more easily removed from the protruding portion 711 of the first die 71.

For reference, the following describes a case where the inclined molding surfaces 719 are not formed in the recession-shaped depression 710 as shown in the example shown in FIG. 10. In the example shown in FIG. 10, a depression 710B in the leading end surface of a protruding portion 711B of a first die 71B of a die 7B does not include the molding surfaces 719 that are inclined so as to gradually extend toward the leading end surface side while extending laterally from the depression 710B. Here, the depression 710B includes a planar surface 716B and a pair of side surfaces 717B that project from the planar surface 716B in the projecting direction of the protruding portion 711B of the first die 71B. The pair of side surfaces 717B are configured to be parallel with the pair of side wall surfaces 728 of the second die 72. In this case, as shown in FIG. 10, the projecting portion 28B having a shape corresponding to the depression 710B does not have the inclined surfaces 280, but rather has perpendicular surfaces 280B that extend along the direction of separation of the first die 71B and the second die 72. Here, the reaction force that is in response to the compression force from the protruding portion 711B of the first die 71B and that remains as residual stress in the perpendicular surfaces 280B is the second force P2 that acts in a direction orthogonal to the direction of separation of the first die 71B and the second die 72. In other words, the third force P3 that acts in the direction of separation of the first die 71B and the second die 72 is not generated in the perpendicular surfaces 280B. For this reason, in the example shown in FIG. 10, the weld portion 2 is difficult to remove from the first die 71B.

As shown in FIG. 11, in the third step after the second step, the first die 71 is moved away from the second die 72, and the conductive member 100 provided with the weld portion 2 is removed. Accordingly, it is possible to obtain the conductive member 100 provided with the weld portion 2 in the end portion. Note that in the present embodiment, the weld portion 2 is formed at each of the two ends, and therefore the first to third steps are performed on the other end portion as well. Then, after the third step is complete, terminal-equipped conductive member 110 can be obtained by performing the crimping step of crimping the crimp portion 91 of the terminal 9 and the weld portion 2.

Effects

In the present embodiment, the performed steps include the heating step of heating the weld portion formation region 2X, which is a portion, with respect to the extending direction, of the conductive member 100 constituted by the metal strands 11, and the pressing step in which the heated weld portion formation region 2X is sandwiched between and pressed by the protruding portion 711 of the first die 71 and the recessed portion 721 of the second die 72. By performing the heating step and the pressing step on the weld portion formation region 2X, the weld portion 2 is formed in the conductive member 100. Also, the weld portion 2 is provided with the projecting portion 28 having a protrusion shape corresponding to the recession-shaped depression 710 formed in the leading end surface of the protruding portion 711 of the first die 71. Here, it is thought that when the conductive member 100 is sandwiched between the protruding portion 711 of the first die 71 and the recessed portion 721 of the second die 72, portions of the metal strands 11 enter the clearances 70 between the side surfaces of the protruding portion 711 of the first die 71 and the inner side surfaces (pair of side wall surfaces 728) of the recessed portion 721 of the second die 72. It thought that when the portions that entered the clearances 70 melt and then harden, the pair of lateral projecting portions 29 are formed in the weld portion 2 in addition to the projecting portion 28. Here, when compressed by the protruding portion 711 of the first die 71, reaction force in response to compression force from the protruding portion 711 of the first die 71 is generated in the lateral projecting portions 29. When the first die 71 is moved away from the second die 72, the aforementioned reaction force in the lateral projecting portions 29 remains as residual stress inside the lateral projecting portions 29, and this residual stress includes the first force P1 acting in the direction of hugging the protruding portion 711 of the first die 71. The first force P1 is force acting in a direction orthogonal to the direction of separation of the first die 71 and the second die 72. For this reason, the pair of lateral projecting portions 29 that hug the protruding portion 711 of the first die 71 can be a cause of difficulty in removing the weld portion 2 from the first die 71. However, in the present embodiment, the projecting portion 28 of the weld portion 2 includes the inclined surfaces 280 that correspond to the molding surfaces 719 of the depression 710. The inclined surfaces 280 are surfaces that are inclined so as to gradually extend downward toward the central side of the weld portion 2 while extending laterally from the projecting portion 28. In this case, the reaction force that is in response to the compression force from the protruding portion 711 of the first die 71 and that remains as residual stress in the inclined surfaces 280 has the second force P2 in a direction orthogonal to the direction of separation of the first die 71 and the second die 72, and the third force P3 in the direction of separation of the first die 71 and the second die 72. For this reason, due to the inclined surfaces 280 being formed in the projecting portion 28, the third force P3 acting in a direction of separation of the weld portion 2 from the first die 71 is generated. Accordingly, the weld portion 2 can be more easily removed from the protruding portion 711 of the first die 71.

Also, in the present embodiment, metal strands 11 are bonded to each other by portions in which the sheath portions 12 melt and harden. Here, by melting mainly only the sheath portions 12, adjacent sheathed metal strands 1 become bonded together, and the weld portion 2 is formed. In this case, it is possible to suppress excessive stiffening of the weld portion 2. Also, in the process of formation of the weld portion 2, the sheathed metal strands 1 are not heated excessively, thus making it possible to suppress the case where the entirety of the end portion of the sheathed metal strands 1 enters a fluid state. In other words, the metal strands 11 maintain a certain hardness instead of melting, thus making it possible to easily perform the operation of removal from the die 7 and the pressing operation, for example. As a result, the weld portion 2 can be provided easily. Note that here, the alloy portions 13 that cover the majority of the outer circumferential surfaces of the metal strands 11 also do not melt, thus making it possible to provide the weld portion 2 even more easily.

Also, in the present embodiment, the depression 710 of the protruding portion 711 of the first die 71 includes the pair of molding surfaces 719 that are inclined so as to gradually extend toward the leading end surface while extending in respective lateral directions from the depression 710. In this case, the projecting portion 28 includes the pair of inclined surfaces 280 that correspond to the pair of molding surfaces 719, thus making it possible to increase the amount of force in the direction of separation of the weld portion 2 from the first die 71.

Also, in the present embodiment, the leading end portions of the pair of lateral projecting portions 29 formed on respective sides of the projecting portion 28 have a rounded shape. The pair of lateral projecting portions 29 are portions formed by the melting and then hardening of portions of the metal strands 11 that enter the clearances 70 between the protruding portion 711 of the first die 71 and the recessed portion 721 of the second die 72, for example. In this case, it is possible to suppress the case where the leading end portions of the pair of lateral projecting portions 29 come into contact with and damage another member.

Variations

Figure 12:
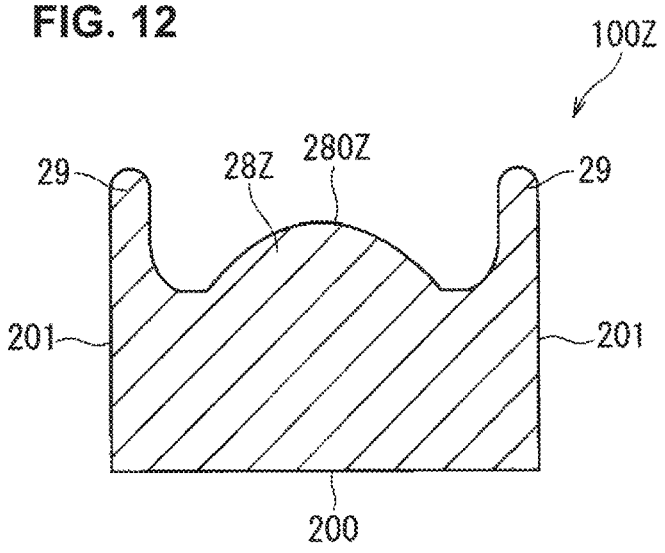
FIG. 12 is a cross-sectional view of a weld portion of a conductive member according to a variation.

Next, a conductive member 100Z according to a variation will be described with reference to FIG. 12. FIG. 12 is a cross-sectional view of the weld portion 2 of the conductive member 100Z. Note that in FIG. 12, constituent elements that are the same as constituent elements shown in FIGS. 1 to 11 are denoted by the same reference signs.

In this variation, the shape of a projecting portion 28Z formed on the weld portion 2 is different from that of the projecting portion 28 of the embodiment. Here, an inclined surface 280Z of the projecting portion 28Z includes a surface that is inclined in a curving manner (i.e., an inclined curved surface) in a view from the extending direction of the conductive member 100. Here, as shown in FIG. 12, the projecting portion 28Z includes only the curved inclined surface 280Z. Specifically, the projecting portion 28Z is formed to overall have a rounded shape. Note that in this case, it is thought that the recession-shaped depression 710 of the protruding portion 711 of the first die 71 also includes a molding surface 719 that corresponds to the inclined surface 280Z of the projecting portion 28Z.

Application Example

A case is also conceivable in which if the metal strands 11 of the sheathed metal strands 1 are made of copper, the sheath portions 12 are nickel plating, silver plating, or the like.

A case is also conceivable in which the metal strands 11 of the sheathed metal strands 1 are made of a metal other than copper. For example, a case is conceivable in which the metal strands 11 are made of metal whose main component is aluminum. In this case, it is conceivable that the sheath portions 12 are zinc plating, tin plating, or the like.

Note that in the conductive member production method, the conductive member, and the die according to the present invention, the embodiments and application examples described above can be freely combined, and modifications or partial omissions may be appropriately applied to the embodiments and application examples, within the scope of the invention described in the claims.

LIST OF REFERENCE NUMERALS

1 Sheathed metal strand
100 Conductive member
11 Metal strand
12 Sheath portion
2 Weld portion
28 Projecting portion
280 Inclined surface
29 Lateral projecting portion
2X Weld portion formation region
7 Die
70 Clearance
71 First die
711 Protruding portion
719 Molding surface
72 Second die
721 Recessed portion
728 Side wall surface
8 Depression portion
9 Terminal
91 Crimp portion
P1 First force
P2 Second force
P3 third force

The invention claimed is:

1. A conductive member production method performed with a die that includes a first die and a second die, the first die including a protruding portion having a recession-shaped depression formed in a leading end surface, the depression including a molding surface that is inclined so as to gradually extend toward a leading end surface side while extending laterally from the depression, and the second die including a recessed portion into which the protruding portion can be inserted, the method comprising:

heating a weld portion formation region that is a portion, with respect to an extending direction, of a conductive member including a plurality of metal strands that are woven into a tube shape or a plurality of metal strands that are woven into a sheet shape; and pressing the heated weld portion formation region sandwiched between the protruding portion of the first die and the recessed portion of the second die.

2. The conductive member production method according to claim 1, wherein the conductive member includes a plurality of sheathed metal strands that include the plurality of metal strands and electrically conductive sheath portions that respectively surround the plurality of metal strands, and the heating is performed at a temperate that is higher than a melting point of the sheath portions and lower than a melting point of the metal strands.

3. The conductive member production method according to claim 1, wherein the depression of the first die includes a pair of the molding surfaces that are inclined so as to gradually extend toward the leading end surface side while extending in respective lateral directions from the depression.

4. A conductive member including a plurality of metal strands, the conductive member comprising:

a weld portion in which at least a portion of the plurality of metal strands in an extending direction of the plurality of metal strands is welded, wherein a protrusion-shaped projecting portion is formed on the weld portion, the projecting portion includes an inclined surface that is inclined so as to gradually extend downward toward a central side of the weld portion while extending laterally from the projecting portion in a view from the extending direction, a pair of lateral projecting portions formed on respective sides of the projecting portion are formed on the weld portion, and leading end portions of the pair of lateral projecting portions have a rounded shape.

5. The conductive member according to claim 4, wherein the conductive member includes a plurality of sheathed metal strands that include the plurality of metal strands and electrically conductive sheath portions that respectively surround the plurality of metal strands, and the weld portion includes a portion in which the plurality of metal strands are bonded together by portions in which the sheath portions are melted and hardened.

6. The conductive member according to claim 4, wherein the inclined surface includes a surface that is inclined in a straight line in a view from the extending direction.

7. The conductive member according to claim 4, wherein the inclined surface includes a surface that is inclined in a curved manner in a view from the extending direction.

8. The conductive member according to claim 4, wherein the projecting portion includes a pair of the inclined surfaces that are inclined so as to gradually extend downward toward the central side of the weld portion while extending in respective lateral directions from the projecting portion in a view from the extending direction.

9. A die comprising:

a first die that includes a protruding portion having a recession-shaped depression formed in a leading end surface; and a second die that includes a recessed portion into which the protruding portion can be inserted, wherein the depression includes a molding surface that is inclined so as to gradually extend toward a leading end surface side while extending laterally from the depression, and spaces are provided between two side surfaces of the protruding portion of the first die and a pair of inner side surfaces of the recessed portion of the second die.

10. The die according to claim 9, wherein the depression includes a pair of the molding surfaces that are inclined so as to gradually extend toward the leading end surface side while extending in respective lateral directions from the depression.

* * * * *